US008766541B1

(12) United States Patent
Hoff et al.

(10) Patent No.: US 8,766,541 B1
(45) Date of Patent: Jul. 1, 2014

(54) NONLINEAR TRANSMISSION LINE MODULATED ELECTRON BEAM EMISSION

(75) Inventors: Brad W. Hoff, Albuquerque, NM (US); David M. French, Albuquerque, NM (US); Donald A. Shiffler, Albuquerque, NM (US); Susan L. Heidger, Albuquerque, NM (US); Wilkin W. Tang, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 122 days.

(21) Appl. No.: 13/245,250

(22) Filed: Sep. 26, 2011

(51) Int. Cl.
*H01J 7/24* (2006.01)

(52) U.S. Cl.
USPC ..... 315/111.81; 315/111.71; 315/111.21; 315/111.51; 315/111.91; 315/111.41

(58) Field of Classification Search
USPC ..... 315/111.21–111.81
See application file for complete search history.

(56) References Cited

U.S. PATENT DOCUMENTS 4,335,297 A * 6/1982 Little ..... 219/121.24
4,422,013 A * 12/1983 Turchi et al. ..... 315/111.81
5,977,715 A * 11/1999 Li et al. ..... 315/111.51
6,291,940 B1 * 9/2001 Scholte Van Mast .... 315/111.81
6,686,680 B2 * 2/2004 Shaw et al. ..... 313/309
7,298,091 B2 * 11/2007 Pickard et al. ..... 315/111.51
7,905,982 B2 * 3/2011 Howald et al. ..... 156/345.48
8,125,155 B2 * 2/2012 Chistyakov ..... 315/111.21

OTHER PUBLICATIONS

Jason M Sanders et al, "Pulse sharpening and solition generation with NLTL for producing RF bursts" 2010 IEEE International Power Modulation and High Voltage Conference May 2010 p. 604-607.*
Pulse sharpening and soliton generation with NLTL for producing RF Bursts (2010 IEEE International Power Modulator and High Voltage Conference, May 2010, p. 604-607) by Jason M Sanders et al.*
Web publication "Velocity-modulated Tubes" 2011 (www.radartutorial.eu) p3 two cavity Klystron.*
Scalable compact Nanosecond Pulse Generator with a High Repetition rate for Biomedical applications requiring Intense electric fields by Sanders et al (Sanders2) in 17th IEEE International pulsed power conference Washington DC 2009.*
Electrical solicitor David Rickets IEEE Transactions on microve theory and techniques vol. 54, No. 1, Jan. 2006.*

* cited by examiner

*Primary Examiner* — Douglas W Owens
*Assistant Examiner* — Srinivas Sathiraju
(74) *Attorney, Agent, or Firm* — James M. Skorich

(57) ABSTRACT

A method to modulate the density of an electron beam as it is emitted from a cathode, the method comprised of connecting a source of pulsed input power to the input end of a nonlinear transmission line and connecting the output end directly to the cathode of an electron beam diode by a direct electrical connection.

8 Claims, 7 Drawing Sheets

NONLINEAR TRANSMISSION LINE MODULATED ELECTRON BEAM EMISSION

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

The present invention is generally related to a method for modulating the density of an electron beam as it is released from a cathode, and in particular relates to coupling a cathode to a nonlinear transmission line to modulate an electron beam emitted by the cathode.

In many electron beam-related applications, it is highly desirable or necessary to be able to modulate the density of an electron beam as it is released from the cathode. In grid-controlled microwave tubes, such as inductive output tubes and planar triodes, this is done by applying a dc voltage between the cathode and anode of a vacuum diode and then using a control grid with a time varying voltage bias a very short distance (as little as ~0.1 mm) from the cathode. The control grid bias determines the amount of current that is released from the cathode. The highest frequency of these tubes is limited by the electron transit time in the cathode to grid region. The requirement for a cathode control grid increases expense and complexity as well as introducing additional failure methods (such as inadvertent shorting of the cathode to the grid due to contaminates or warping of the grid or cathode).

In many accelerators, a modulated electron beam is created using laser light pulses to eject electrons from a photocathode. The laser system and associated focusing optics add considerable cost and complexity to accelerator cathodes.

This invention provides a novel and more efficient way to modulate the current density of an electron beam emitted from a cathode without the need for complicated control grids or laser-based photoemission techniques used in current microwave tubes and accelerators.

SUMMARY

The present invention provides a novel and more efficient way to modulate the current density of an electron beam emitted from a cathode without the need for complicated control grids or laser-based photoemission techniques currently in use. The current density is modulated by coupling a vacuum diode to a nonlinear transmission line (NLTL). This connection may be made from the NLTL to the cathode or from the NLTL to the anode of the electron beam diode.

A dispersive NLTL can be used to convert a pulsed voltage input into a modulated output at microwave frequencies. A non-dispersive NLTL, or shockline, can be coupled to the cathode to produce an electron beam with a very sharp density gradient on the leading edge of the beam. Because the NLTL can be incorporated into the power system, this invention enables one to directly modulate the input voltage pulse to the cathode in a controllable and repeatable manner at high frequencies (>500 MHz) and provides a technique that is simpler, less expensive, and more robust than current methods.

DESCRIPTION OF THE PREFERRED EMBODIMENT

Figure 1:
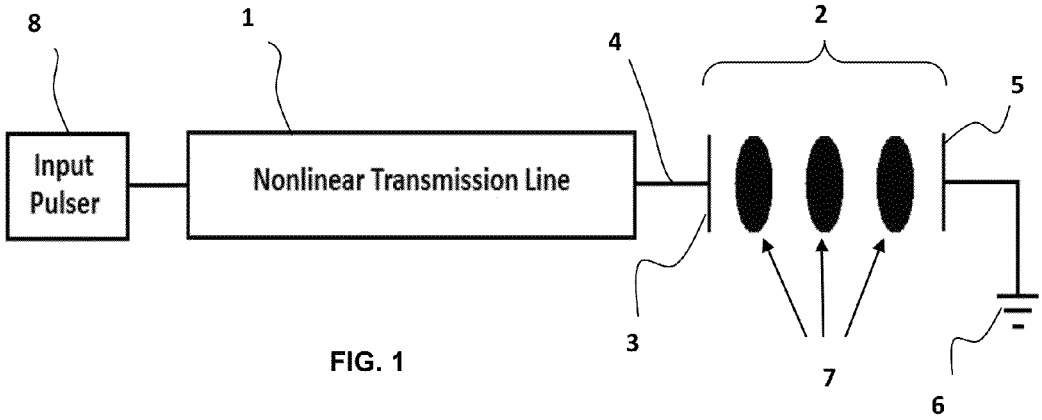
FIG. 1 is a conceptual drawing which describes the coupling of a nonlinear transmission line to the cathode or anode of an electron beam diode in order to allow for the generation of a modulated electron beam.

FIG. 1 is a conceptual drawing of one embodiment of the present invention in which a nonlinear transmission line 1 (NLTL) is coupled to an electron beam diode of an electron beam device 2. A first terminal 3 of the electron beam diode is connected to the output of the nonlinear transmission line (NLTL) 1 via a connection 4 which can represent either a direct connection between terminal 3 and the NLTL or a connection via a length of transmission line. In this drawing, a second terminal 5 is connected to ground 6. In the case where the modulated potential applied to the first terminal 3 is negative with respect to the grounded terminal 5, the first terminal 3 will be the cathode and the modulated electron beam 7 will travel from the cathode toward the grounded terminal or anode 5. In the case where the modulated potential applied to the first terminal 3 is positive with respect to the grounded terminal 5, the grounded terminal will be the cathode and the modulated electron beam 7 will travel from the cathode 5 toward the anode 3. The input pulser 8 provides pulsed input power to the NLTL. The NLTL may be coupled to the anode or cathode of an electron beam diode by either a direct electrical connection or via a capacitive or inductive coupling connection. The specific nature of the connection will change depending on the type of NLTL or cathode/anode used as would be apparent to one skilled in the art.

The nonlinearity of the electromagnetic response of the nonlinear transmission line may be due to nonlinear dielectric materials, nonlinear magnetic materials, or a combination of nonlinear dielectric and nonlinear magnetic materials. Additionally, this nonlinear transmission line may be dispersive or a shock line.

Figure 2:
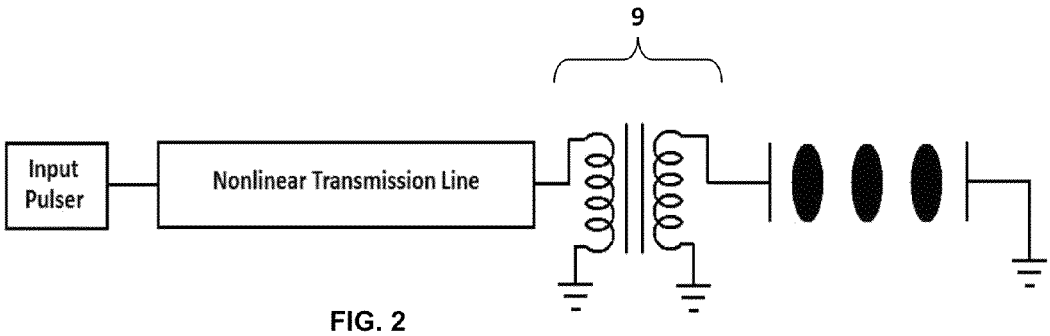
FIG. 2 is a conceptual drawing which describes the coupling of a nonlinear transmission line to the cathode or anode of an electron beam diode via an impedance transformer to allow for the generation of a modulated electron beam.

FIG. 2 depicts a NLTL coupled to an electron beam diode 2 via an impedance transformer 9. This type of configuration would prove to be advantageous in cases where the electron beam diode impedance differs substantially from the output impedance of the NLTL.

The electron beam diodes depicted in FIG. 1 and FIG. 2 are greatly simplified to allow for ease of understanding of the present invention. Additionally, although the grounded terminal 5 of FIG. 1 and FIG. 2 is shown to be tied to ground for the sake of simplicity, both the cathode and anode could, in principle, be separately biased with respect to ground such that the effective voltage across the diode would be the difference of the dc biases on the cathode and anode plus the modulated voltage output of the NLTL.

Figure 3:
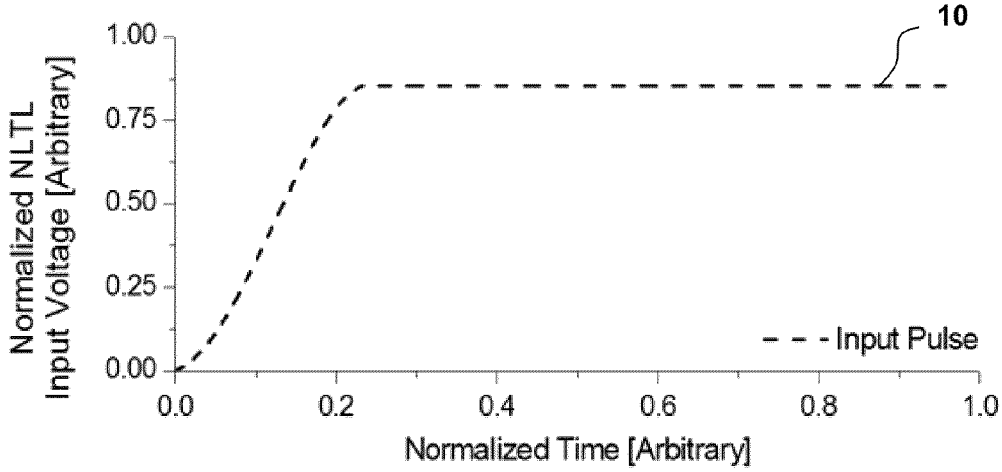
FIG. 3 is a plot of the input signal for a hypothetical non-dispersive nonlinear transmission line "shock line."
Figure 4:
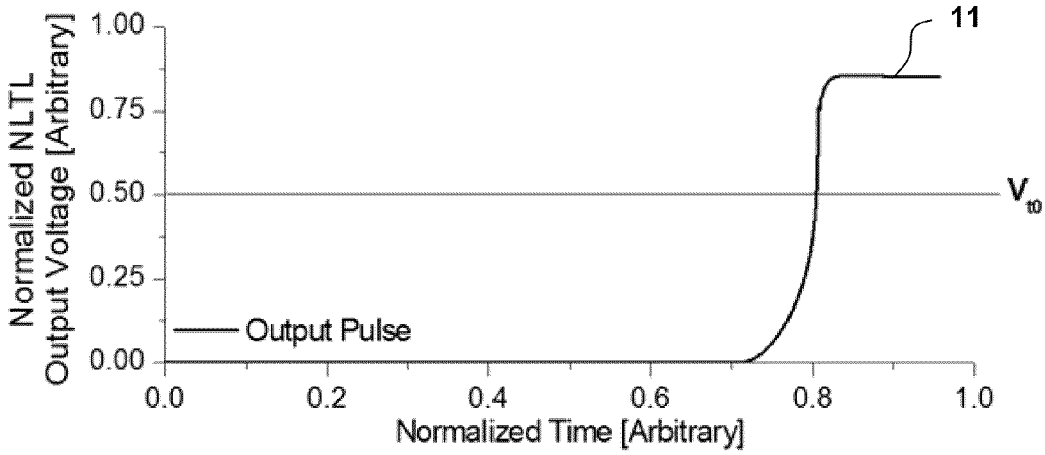
FIG. 4 is a plot of the output signal for a hypothetical non-dispersive nonlinear transmission line "shock line." The long rise time input pulse of FIG. 3 is converted to a very short rise time voltage pulse by the shock line.

FIG. 3 is a plot of an input signal of a simulated nonlinear transmission line shock line. The long rise time input voltage pulse 10 of FIG. 3 is sharpened to a much shorter rise time voltage pulse 11 during its transit down the shock line as seen in FIG. 4. The voltage scales and the time scales in both plots are normalized. The voltage threshold $Vt_o$ is chosen as an example emission threshold for a hypothetical cathode.

Figure 5:
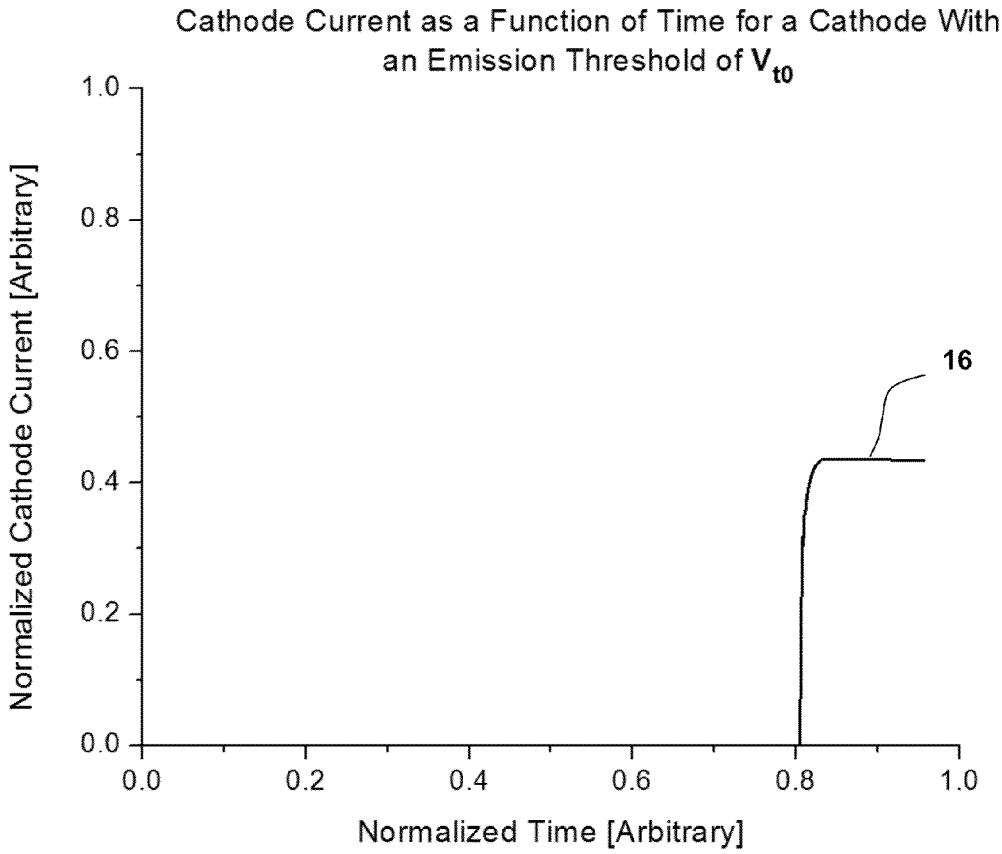
FIG. 5 is plot of the predicted cathode current as a function of time for a cathode with an emission threshold of $Vt_0$ in an electron beam diode across which the voltage waveform of FIG. 4 is applied.

FIG. 5 is a plot of the predicted cathode current 16 as a function of time for a cathode with an emission threshold of $Vt_o$ in a electron beam diode, across which the voltage waveform 11 of FIG. 4 is applied. For the purposes of this illustration, it was assumed that the cathode is an idealized space-charge-limited emission cathode in which the electron emission scales as a function of voltage to the 3/2 power, $V^{3/2}$. In actual practice, the emission properties and type of each individual cathode must be taken into account when calculating predicted current yields. The cathode current scale in this plot is normalized for simplicity. The time scale is the same as that used in FIG. 4.

Figure 6:
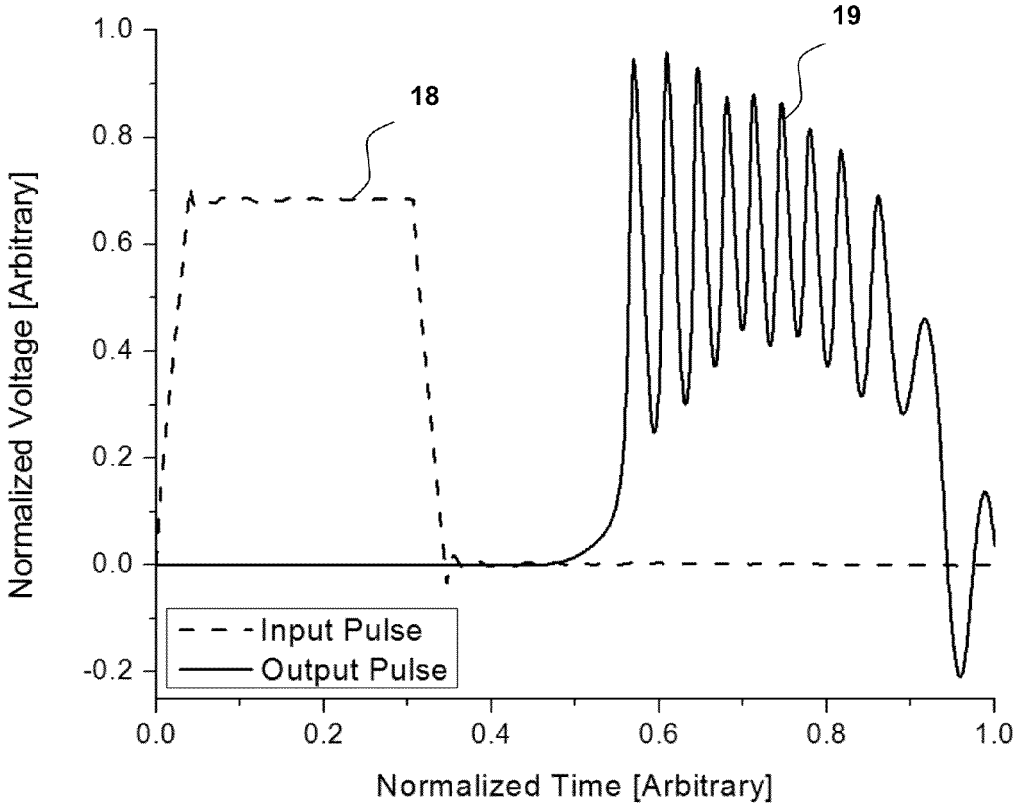
FIG. 6 is a plot of the input and output voltage signals for a dispersive nonlinear transmission line. The input signal is converted to a modulated output signal by the nonlinear transmission line.

FIG. 6 is a plot of the input and output voltage signals from a simulated dispersive nonlinear transmission line. The NLTL converts the video pulse-like input signal 18 into an RF output signal or output signal consisting of a series of electromagnetic soliton-like pulses 19. A normalized voltage scale and time scale were used in this plot. The output signal 19 of the NLTL data in FIG. 6 is again shown in FIG. 7 as it is applied across an electron beam diode. The voltage thresholds $V_{t1}$ and $V_{t2}$ are also shown. These voltage thresholds represent electron emission voltage thresholds for two different hypothetical cathodes. The voltage scale and time scale are the same as those used in FIG. 6. As will be evident from the next two figures, the choice of emission threshold allows a degree of control of the modulation amplitude imposed on the electron beam.

Figure 7:
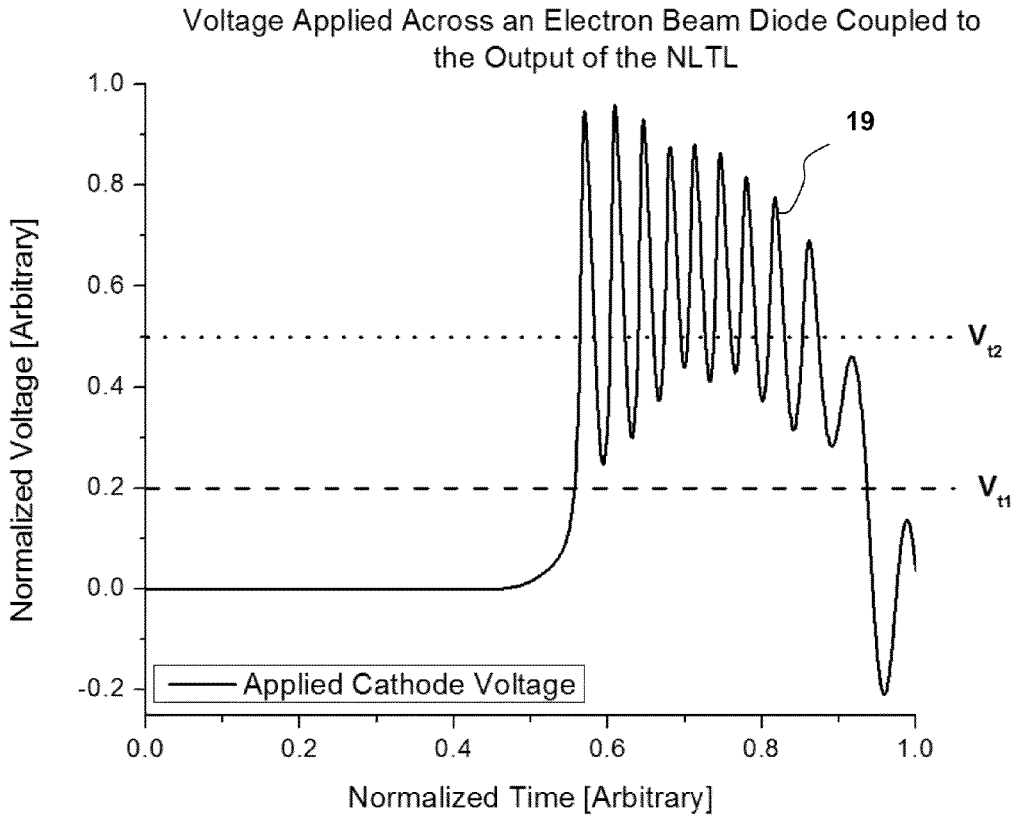
FIG. 7 is a plot of the output voltage signal of FIG. 6 applied as applied across an electron beam diode with voltage thresholds $Vt_1$ and $Vt_2$ shown.
Figure 8:
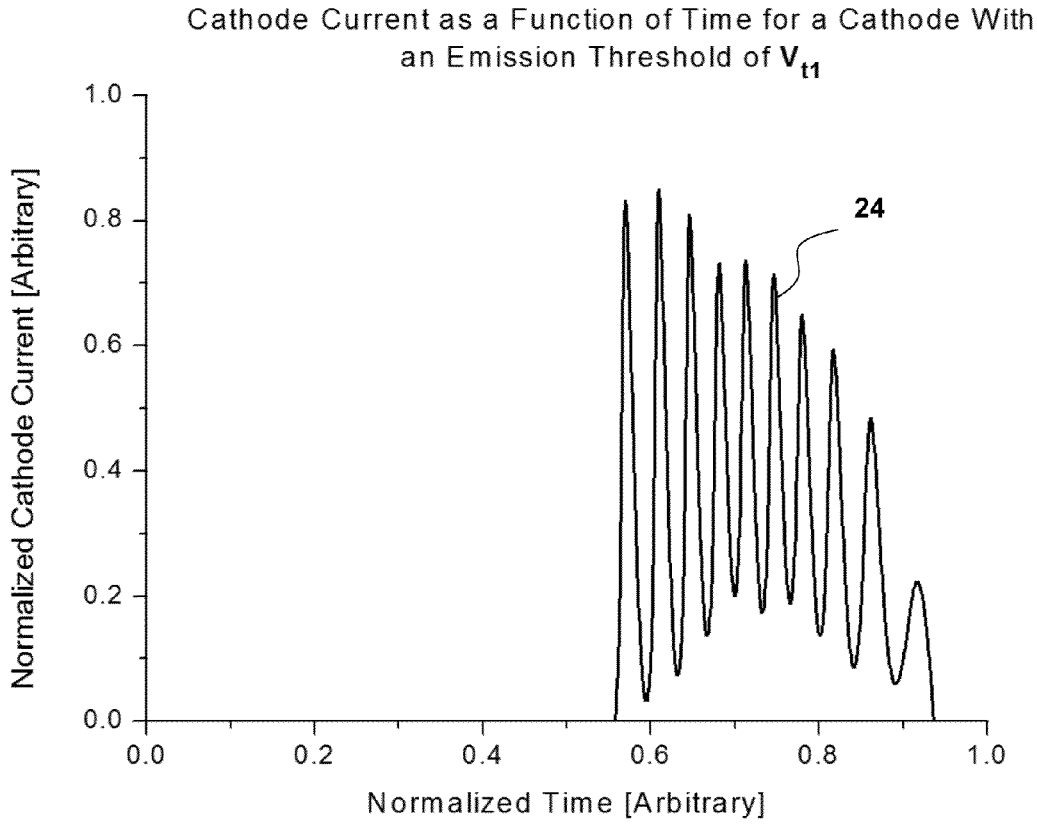
FIG. 8 is a plot of the expected current output of a cathode which is driven by the output of the nonlinear transmission line associated with the traces depicted in FIG. 6 and which has the emission threshold voltage $Vt_1$.

FIG. 8 is a plot of the predicted cathode current 24 as a function of time for a cathode with emission threshold $V_{t1}$ in an electron beam diode, across which the voltage waveform 19 of FIG. 7 is applied. For the purposes of this illustration, it was is assumed that the cathode is an idealized space-charge-limited emission cathode in which the electron emission scales as a function of voltage to the 3/2 power, $V^{3/2}$. As is evident from the plot, the cathode would emit an electron beam which is modulated at the frequency of the output of the NLTL. The cathode current scale is normalized for simplicity. The time scale is the same as that used in FIG. 6.

Figure 9:
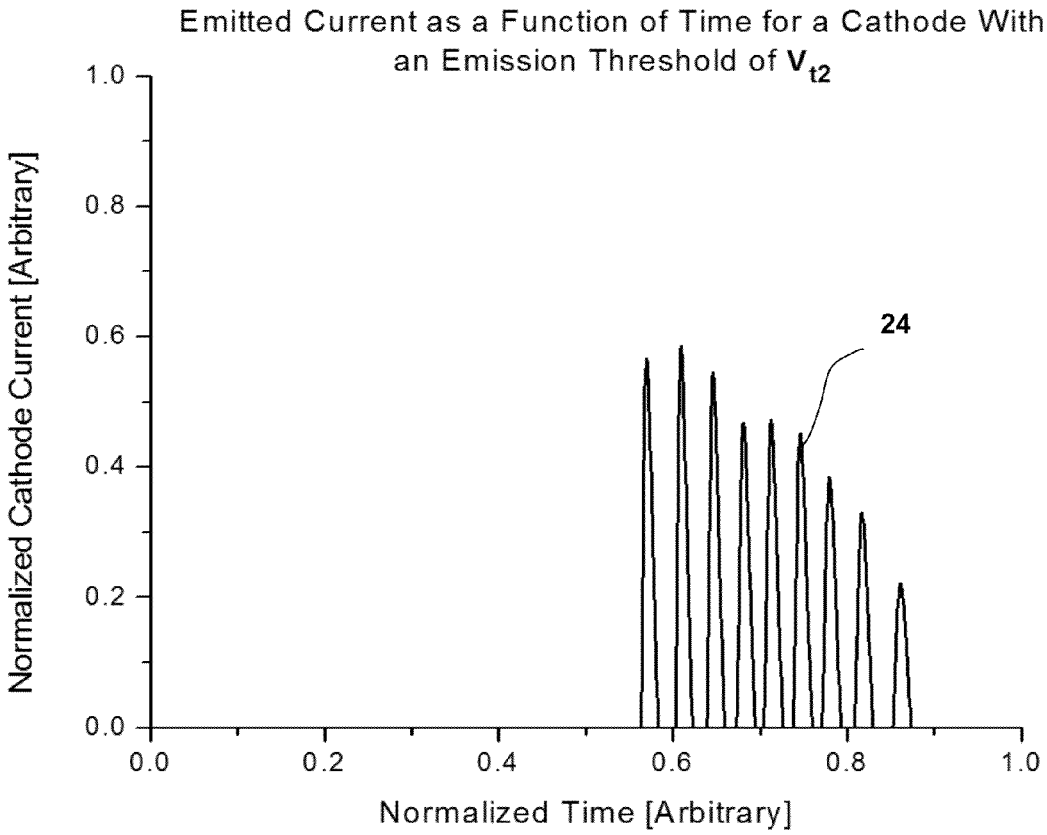
FIG. 9 is a plot of the expected current output of a cathode which is driven by the output of the nonlinear transmission line associated with the traces depicted in FIG. 6 and which has the emission threshold voltage $Vt_2$.

FIG. 9 is a plot of the predicted cathode current 24 as a function of time for a cathode with emission threshold $V_{t2}$ in an electron beam diode, across which the voltage waveform 19 of FIG. 7 is applied. For the purposes of this illustration, it was assumed that the cathode is an idealized space-charge-limited emission cathode in which the electron emission scales as a function of voltage to the 3/2 power. In this case, the choice of electron emission of the cathode results in stronger relative modulation of the electron beam in that discrete electron bunches being emitted from the cathode at the frequency of the output of the NLTL. The cathode current scale is normalized for simplicity. The time scale is the same as that used in FIG. 6.

The invention claimed is:

1. A method to modulate the density of an electron beam as it is emitted from a cathode, the method being comprised of connecting a source of pulsed input power to an input end of a nonlinear transmission line and connecting an output end of said nonlinear transmission line directly to a cathode of an electron beam diode by a direct electrical connection.

2. The method of claim 1, wherein a capacitive or inductive coupling connection is used in place of said direct electrical connection.

3. The method of claim 1, wherein a dispersive nonlinear transmission line is connected between said source of pulsed input power and said cathode of said electron beam diode, whereby an input signal is converted into an output signal consisting of a series electromagnetic soliton-like pulses.

4. The method of claim 3, wherein a capacitive or inductive coupling connection is used in place of said direct electrical connection.

5. A method to modulate the density of an electron beam as it is emitted from a cathode, the method being comprised of connecting a source of pulsed input power to an input end of a nonlinear transmission line, connecting an output end of said nonlinear transmission line to an input: of an impedance transformer, and connecting an output of said impedance transformer directly to a cathode of an electron beam diode by a direct electrical connection, to thereby match electron beam diode impedance to impedance of the nonlinear transmission line.

6. The method of claim 5, wherein a capacitive or inductive coupling connection is used in place of said direct electrical connection.

7. The method of claim 5, wherein a dispersive nonlinear transmission line is connected between said source of pulsed input power and said input of said impedance transformer, whereby an input signal is converted into an output signal consisting of a series of electromagnetic soliton-like pulses.

8. The method of claim 7, wherein a capacitive or inductive coupling connection is used in place of said direct electrical connection.

* * * * *